US006461987B1

(12) United States Patent
Walker et al.

(10) Patent No.: US 6,461,987 B1
(45) Date of Patent: Oct. 8, 2002

(54) CONTINUOUS MICRO-LABEL APPARATUS AND PROCESS

(76) Inventors: Mark Leroy Walker, 1015 E. 1500 North, Layton, UT (US) 84040; Dale O. Butterfield, 2306 E. 45th St., Spokane, WA (US) 99223; Charles W. Gunnell, 1604 E. Pinecrest, Spokane, WA (US) 99203

( * ) Notice: Subject to any disclaimer, the term of this patent is extended or adjusted under 35 U.S.C. 154(b) by 0 days.

(21) Appl. No.: 09/627,490

(22) Filed: Jul. 28, 2000

Related U.S. Application Data

(63) Continuation of application No. 08/978,854, filed on Nov. 26, 1997, now abandoned, and a continuation of application No. 08/456,811, filed on Jun. 1, 1995, now abandoned.

(51) Int. Cl.[7] ..... D04H 1/00

(52) U.S. Cl. ..... 442/340; 442/313; 442/319; 442/334; 442/344; 442/346

(58) Field of Search ..... 428/195; 442/309, 442/313, 319, 334, 340, 344, 346

*Primary Examiner*—Merrick Dixon
(74) *Attorney, Agent, or Firm*—Wells St. John P.S.

(57) ABSTRACT

Disclosed is an apparatus and a method for the manufacture of continuous micro label strips containing a unique identifier, and the placement of the micro label strips into various articles such as cloth and clothing. Microfilm bearing a plurality of transverse or longitudinal rows, each row including one or more unique like identifiers, is longitudinally severed into continuous micro label strips. The strips, or portions thereof, are then woven, sewn or knitted into or onto cloth or clothing.

6 Claims, 8 Drawing Sheets

CONTINUOUS MICRO-LABEL APPARATUS AND PROCESS

RELATED APPLICATIONS

This patent application is a continuation resulting from U.S. patent application Ser. No. 08/978,854, which was an application filed on Nov. 26, 1997 now abondoned, which was an application which was related to and a continuation of that now abandoned U.S. patent application Ser. No. 08/456,811, which was filed Jun. 1, 1995, and entitled CONTINUOUS MICRO-LABEL APPARATUS AND PROCESS.

TECHNICAL FIELD

The present invention relates to a method and apparatus for the manufacture and placement of elongated micro identifiers into various goods and articles, such as into cloth, labels, sewings and others.

BACKGROUND OF THE INVENTION

Identifying indicia have been placed on micro labels and micro dots for the identification of the origin of goods for some time and the uses thereof are expanding very rapidly. Manufacturers desiring to identify and control gray market goods and counterfeit goods, have numerous uses for micro labels and micro dots. In order to be most effective, the micro labels and micro dots must be concealed within the goods or the packaging for the goods such that they are not easily detected or removed.

Prior micro labels gave been directed to achieve the smallest micro label size practical and have typically been circular, i.e. "micro dots" or square shaped, i.e. "micro squares". The prior micro labels have emphasized the micro size and making it as difficult as possible for the micro labels to be detected by the human eye. The micro labels heretofore utilized and concealed have been of such size and configuration that the width is substantially the same as the height, as in squares, circles and rectangles.

While manufacturing techniques are becoming more advanced and more efficient in making the micro labels, the efficient application of the micro labels to certain products and goods is too cumbersome and difficult and the micro labels are not therefore utilized to their fullest possible extent, despite a long felt need in numerous industries.

An example of such an industry is the clothing industry, where there are significant problems with gray market and counterfeit goods. However, micro labels heretofore available for concealment have not been sufficiently reliably concealed or affixed to clothing due to the small size, difficulty in handling and difficulty in efficiently attaching and concealing the micro labels to the clothing.

In the manufacturing process for micro labels, a series of unique identifiers are imposed on a continuous reel of microfilm, as shown in FIG. 1. The typical microfilm is sixteen (16) millimeters (mm) wide and comes in numerous different lengths. While the unique identifiers on the continuous microfilm can be longitudinally or transversely arranged or oriented, the identifiers are normally configured transversely in a plurality of rows, each row containing the unique identifier repeatedly and serially imaged thereon.

In applications wherein a micro dot is to be cut from the microfilm, the size of the punch pin utilized to punch the microfilm and thereby create the micro dot corresponds to the size and relative horizontal and vertical spacing of the identifiers and rows of identifiers on the film, such that no matter where the microfilm is punched, at least one complete identifier is contained on the micro dot created. The microfilm is then typically punched by a micro film punches with a plurality of circular or square cross-sections, thereby creating a plurality of micro labels which then have to be concealed and affixed to the desired goods.

FIG. 3 shows an example of a micro label referred to as a micro dot. As can be seen from this magnified view, there is at least one complete identifier on the micro dot.

Efficiently and reliably concealing and affixing micro dots to cloth and clothing presents many problems, is very difficult and labor intensive. The micro dots are so small, they are difficult to handle, place and attach. For a typical clothing manufacturer to conceal and affix micro dots to clothing generally requires an additional and time consuming step in the manufacturing process. There has not heretofore been a sufficiently effective or efficient way to conceal or affix the micro labels into goods, especially on a rapid or commercial basis, although the need is well recognized.

The forenamed recognized needs have not heretofore been sufficiently fulfilled by any existing apparatus or method. The present invention addresses the problems and needs associated with the efficient and effective manufacture of more easily handled micro labels and the application of micro identifiers to certain goods such as cloth, clothing, labels, fabric and other goods.

The present invention, novel and unique from prior attempts to address the problems and needs identified above, cuts the microfilm containing a plurality of rows of identifiers longitudinally into continuous micro label strips. The continuous micro label strips are then handled according to the specific application.

Using clothing as an example, the present invention therefore has the advantage of being much more easily handled and sewable on or weavable into clothing or to labels and other tags, which are then affixed to the clothing.

BRIEF DESCRIPTION OF THE DRAWINGS

Preferred embodiments of the invention are described below with reference to the accompanying drawings, which are briefly described below.

FIG. 9 is a perspective view of microfilm with longitudinally oriented identifiers cut into continuous micro label strips;

DETAILED DESCRIPTION OF THE PREFERRED EMBODIMENTS

This disclosure of the invention is submitted in furtherance of the constitutional purposes of the U.S. Patent Laws "to promote the progress of science and useful arts"(Article 1, Section 8).

Many of the fastening, connection, process and other means and components utilized in this invention are widely known and used in the field of the invention described, their exact nature or type is not necessary for an understanding and use of the invention by a person skilled in the art or science, and they will not therefor be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefor be discussed in significant detail.

Figure 1:
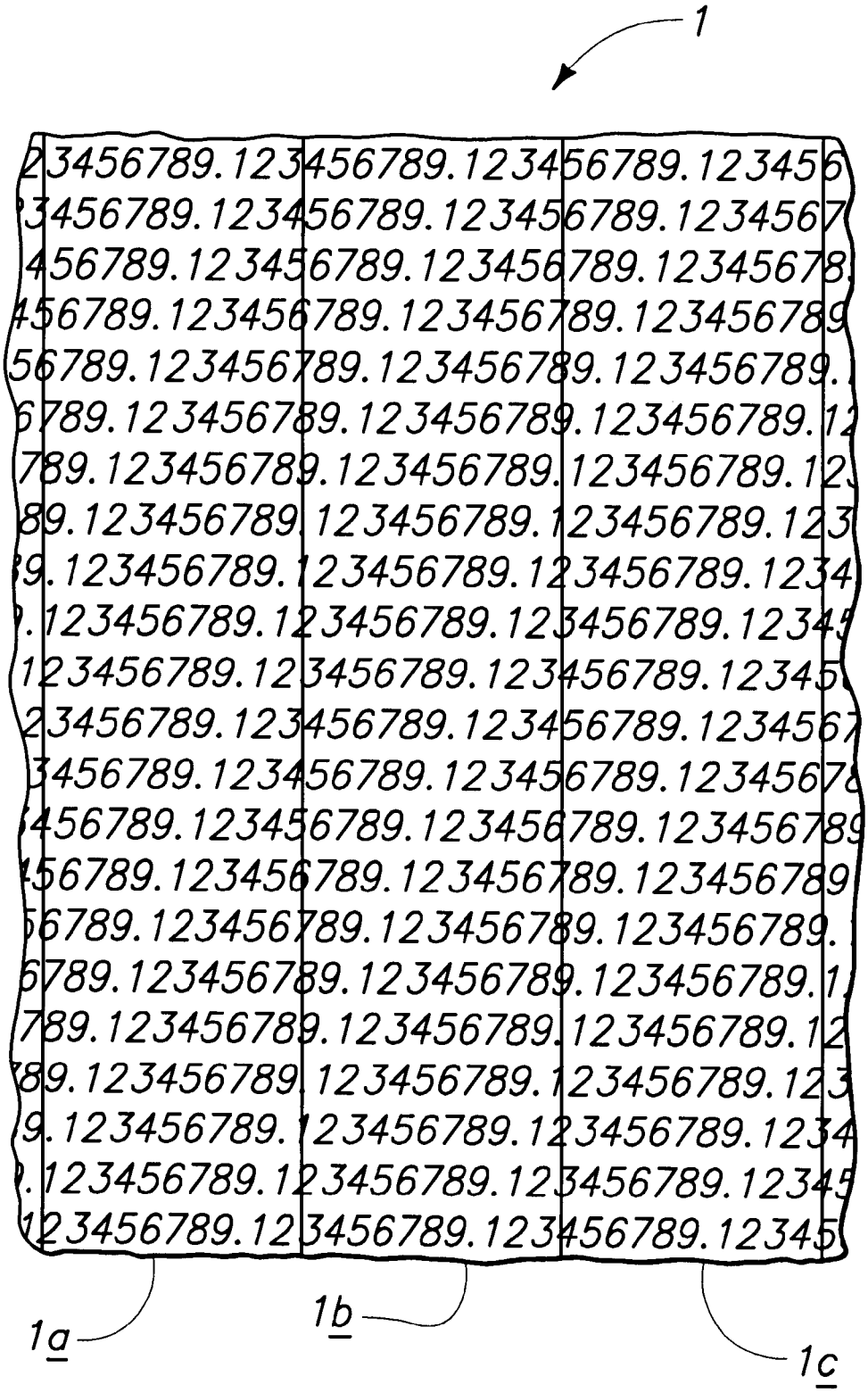
FIG. 1 is an enlarged view of a section of micro film with identifiers transversely imaged thereon.

FIG. 1 illustrates a section of a microfilm 1 from which three continuous micro label strips 1 *a*, 1*b* & 1*c* may be cut in conjunction with this invention. The microfilm 1 contains a plurality of transversely oriented and unique identifiers thereon to be used to track the items onto which the micro label is placed. The unique identifier shown in FIG. 1 is "123456789" and is preceded and followed by an indicia indicating the start and termination of the identifier, i.e. a separator, which in the example in FIG. 1, is a period (.). Therefore the unique identifier contains 9 characters and each separator takes the space of a character, making the continuous micro label strip a total of 11 characters wide.

While the examples shown use numbers as identifiers, letters, symbols, characters and other designs can likewise be used.

Each of the three continuous micro label strips shown in FIG. 1 contain 22 rows of 11 characters. Generally, if the continuous micro label strip is the width of the number of characters of the unique identifier plus the two separators, or eleven in this case, the longitudinal strip must encompass eleven rows in order to be assured that one complete identifier plus its two separators will occur on the continuous micro label strip.

In the example shown in FIG. 1, in the continuous micro label strip 1*a* the complete identifier plus its two separators occurs in the tenth and the twentieth line down, whereas in the continuous micro label strip 1*b* it occurs in the seventh and the eighteenth line down and in the continuous micro label strip 1*c*, in the sixth and the seventeenth line down.

The typical microfilm is sixteen millimeters wide and sixteen one millimeter continuous micro label strips are typically cut from one microfilm, resulting in one millimeter wide strips.

Figure 2:
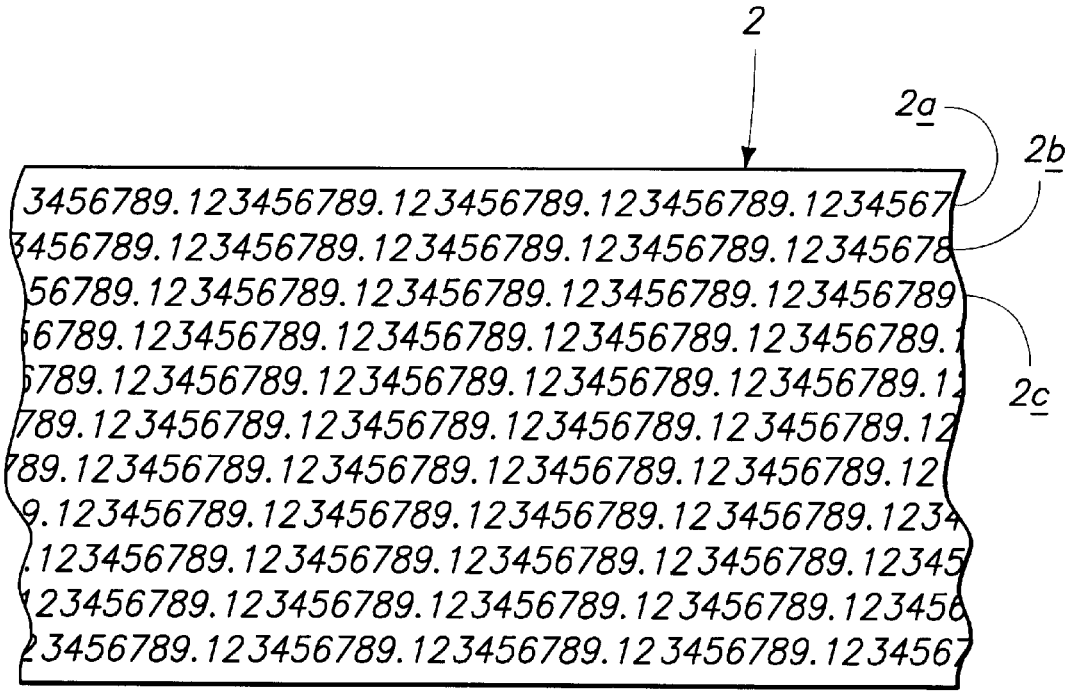
FIG. 2 is an enlarged view of a section of micro film with identifiers longitudinally imaged thereon.

FIG. 2 illustrates a section of microfilm 2 on which a plurality of like unique identifiers are longitudinally oriented into rows, 2*a*, 2*b*, 2*c* and so on.

Figure 3:
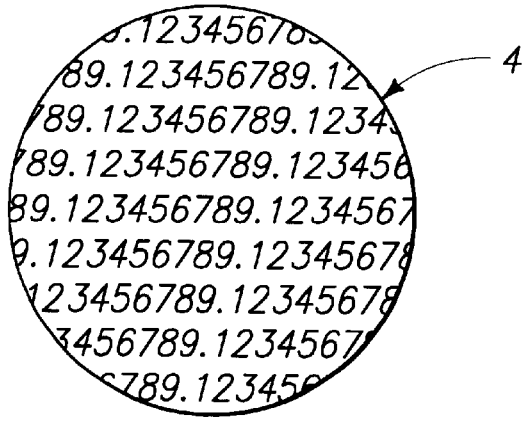
FIG 3 PRIOR ART
FIG. 3 is a magnified view of a micro label generally referred to as a micro dot, containing micro identifiers thereon.

FIG. 3 illustrates an example of a typical micro dot 4 cut from microfilm and containing unique identifiers.

Figure 4:
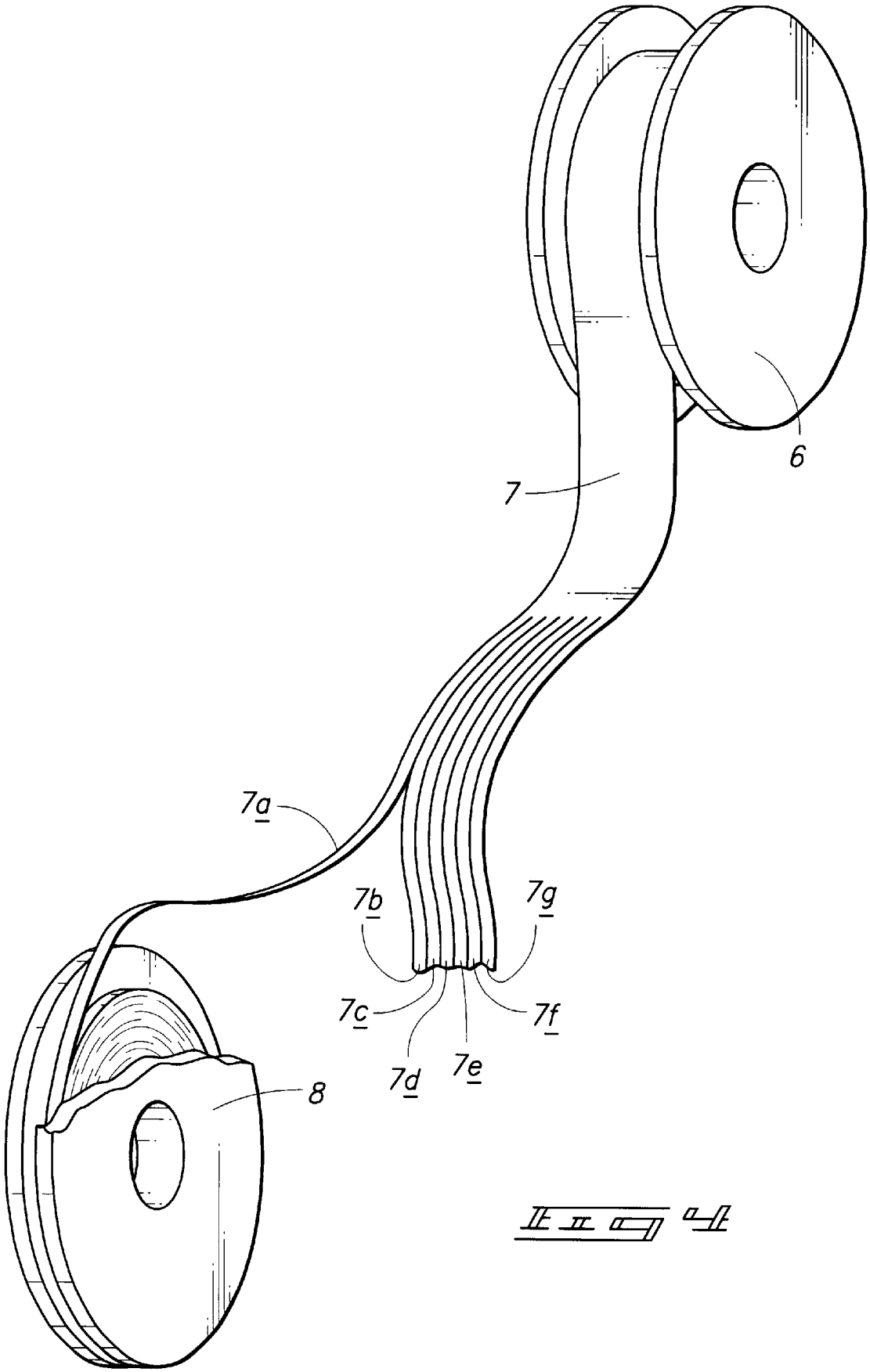
FIG. 4 is a perspective view of a typical roll of microfilm and illustrates that the micro film is being cut into continuous micro strips and placed on reels or spools.

FIG. 4 shows the overall process of a spool 6 containing microfilm 7, with the microfilm being longitudinally severed or cut into a plurality of continuous micro label strips, strip 7*a*, strip 7*b*, strip 7*c*, strip 7*d*, strip 7*e*, strip 7*f* and strip 7*g*. FIG. 4 shows an example of continuous micro label strip 7*a* being wound onto an individual spool 8 for later use.

Figure 5:
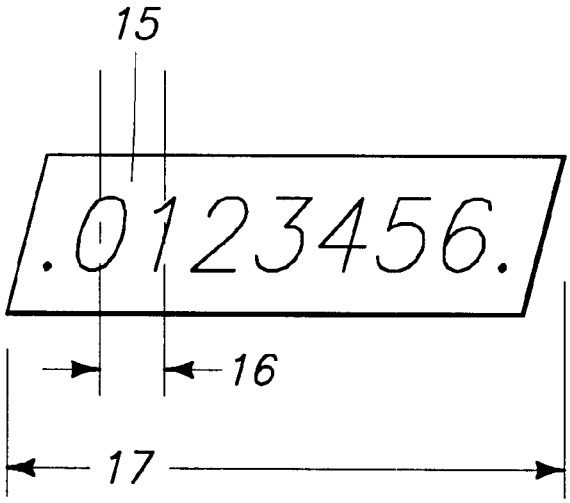
FIG. 5 shows an example of a micro label segment cut from a continuous micro label strip on which identifiers are longitudinally imaged thereon and which is cut to only contain one row of identifiers.

FIG. 5 illustrates a continuous micro label strip segment 15 with the unique identifier "0123456" contained thereon and surrounded by periods (.) as separators. The continuous micro label strip segment 15 was longitudinally cut such that the strip only contains one row of unique identifiers thereon and was cut to length 17. The minimum length the continuous micro label strip segment 15 needs to be cut in order to be assured that each segment has one unique identifier thereon is the number of characters in the unique identifier, plus two for the two separators, times the pitch of the characters used, and then times two.

The pitch of the characters is the distance between the vertical center lines of adjacent characters, or pitch 16 in FIG. 5.

Figure 6:
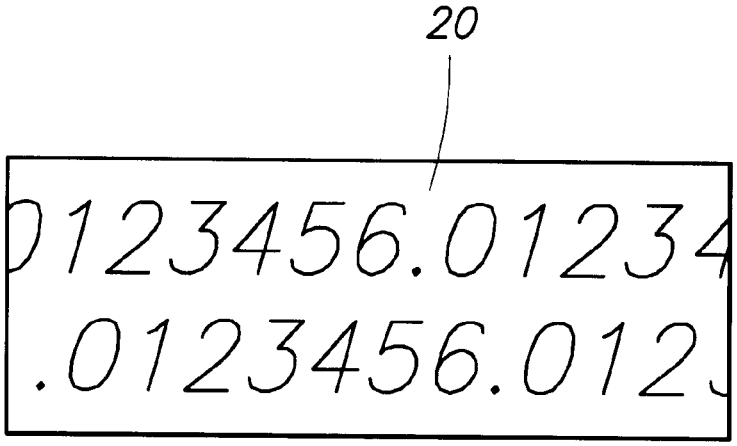
FIG. 6 shows an example of a micro label segment cut from a continuous micro label strip on which identifiers are longitudinally imaged thereon and which is cut to contain two rows of identifiers.

FIG. 6 illustrates a continuous micro label strip segment 20 with the unique identifier "0123456" contained thereon and surrounded by periods (.) as separators. The continuous micro label strip segment 15 was longitudinally cut such that the strip contains two rows of unique identifiers thereon.

Figure 7:
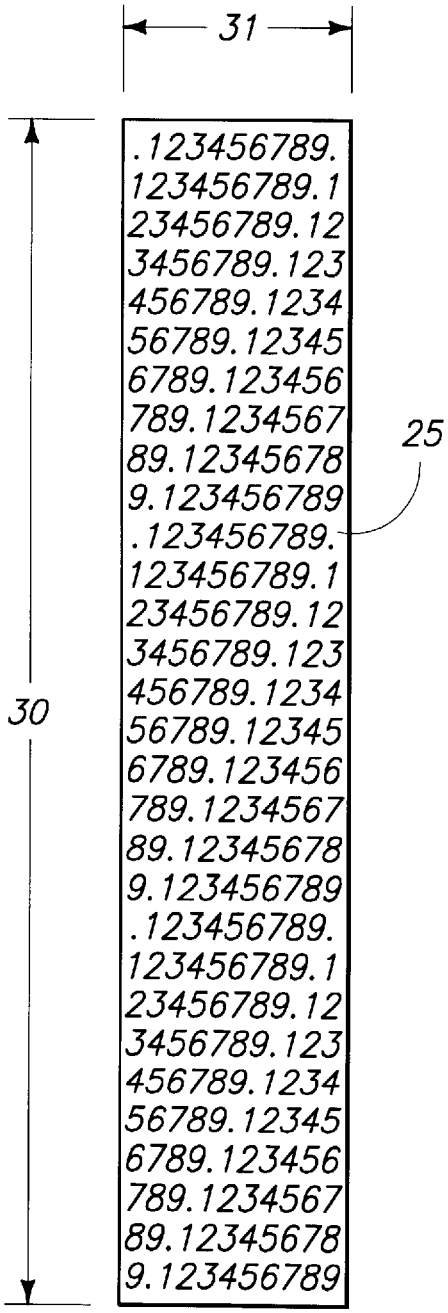
FIG. 7 is an example of the length versus width relationship in cutting a longitudinally imaged continuous micro strip label the width of one identifier plus a identifier separator on each end.

FIG. 7 illustrates a continuous micro label strip segment 25 which was longitudinally cut from a microfilm roll, with a length 30 and a width 31. The unique identifier is the characters "123456789", with periods (.) as the separators. The unique identifiers have been transversely imaged on the microfilm.

FIG. 7 illustrates the relationship between the width 31 of the continuous micro label strip segment 25 and the minimum length 30 required to maintain identifier integrity. A minimum product width would be equal to the length of the identifier plus two characters for the separators. Given the width 31 of the continuous micro label strip being cut to one identifier plus the two separator characters, the minimum length 30 required would be equivalent to the width in character times the line pitch.

Figure 8:
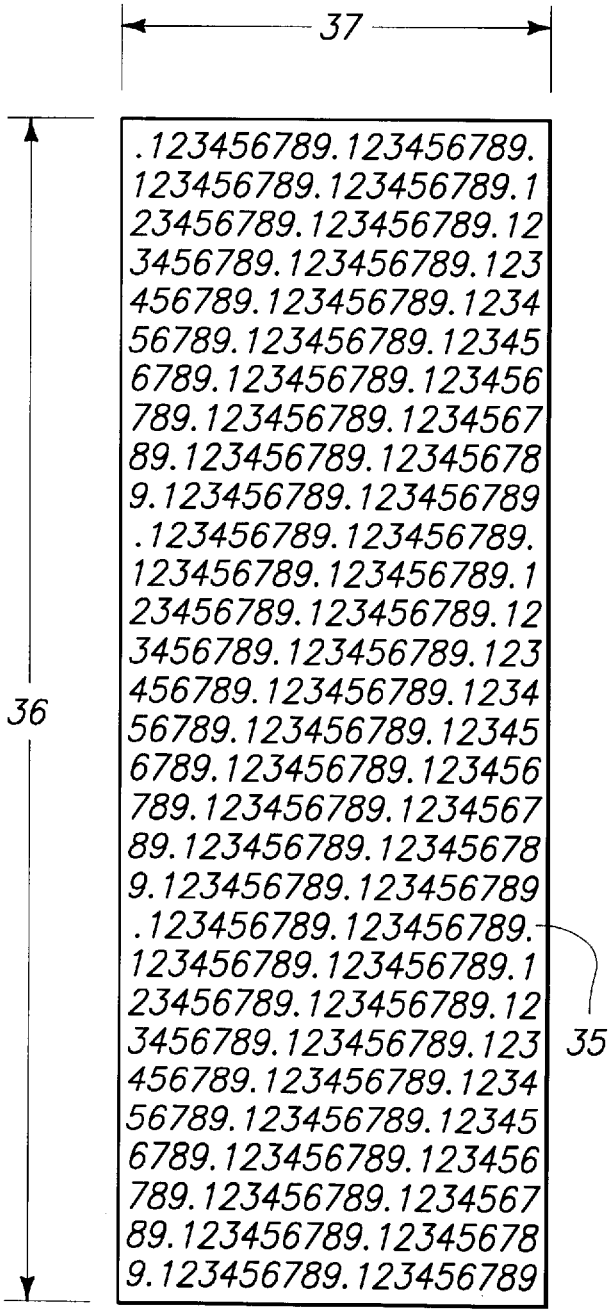
FIG. 8 is an example of the length versus width relationship in cutting a longitudinally imaged continuous micro strip label the width of two identifiers plus three identifier separators.
Figure 6:
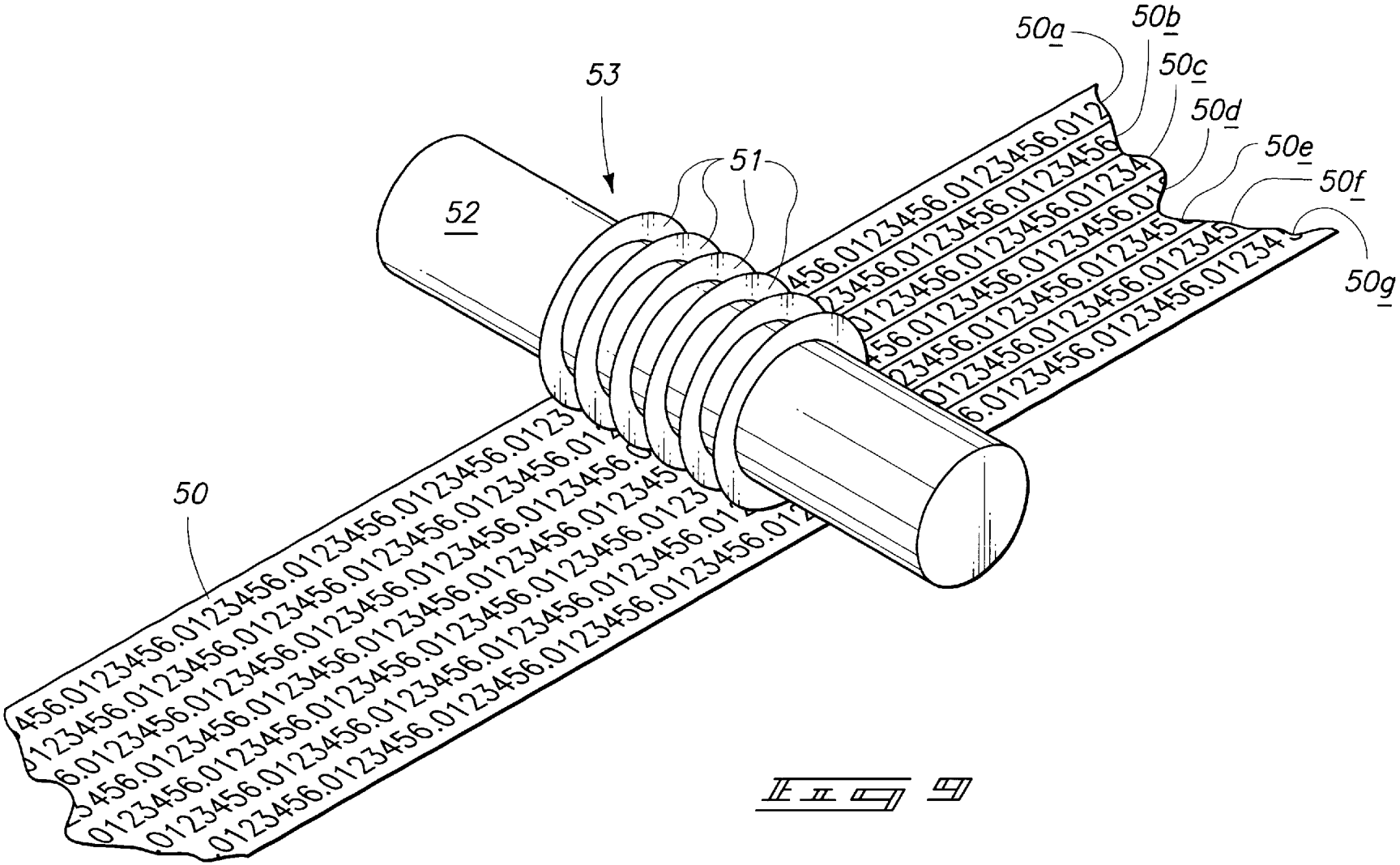

FIG. 8 illustrates the more typical width of a continuous micro label strip segment 35, having a width 37 and a length 36 and unique identifier "123456789". In FIG. 8, the width 37 of the continuous micro label strip segment longitudinally cut from the microfilm is the width of two identifiers plus three pitches for the three separators which are periods.

Given a length 36 of two or more identifiers as shown in FIG. 8, each line is guaranteed to exhibit at least one complete identifier so a length 36 equaling two lines would suffice to have a least one unique identifier on each continuous micro label strip segment.

Although there are many known cutting means for severing the microfilm into a plurality of continuous micro label strips, FIG. 9 illustrates one such way. The microfilm 50 is fed under the microfilm cutter 53, which includes axis 52 and annular blades 51. The example illustrated in FIG. 9 shows the cutter 53 severing the microfilm 50, with longitudinally oriented unique identifiers, into seven continuous micro label strips, namely segment 50*a*, segment 50*b*, segment 50*c*, segment 50*d*, segment 50*e*, segment 50*f* and segment 50*g*. Each segment in the example in FIG. 9 contains only one longitudinally oriented row, which includes a plurality of unique like identifiers.

The microfilm can also be cut by other known mechanical and laser cutting means.

Figure 10:
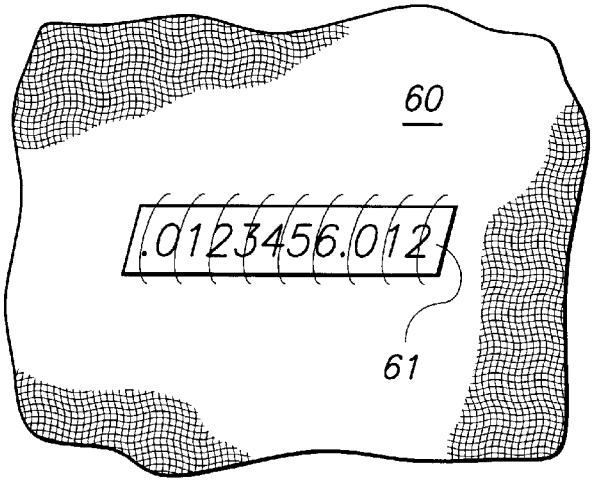
FIG. 10 shows a micro label strip segment sewn to cloth.

Is FIG. 10 illustrates a continuous micro label strip segment 61 sewn to a section of cloth 60.

Figure 11:
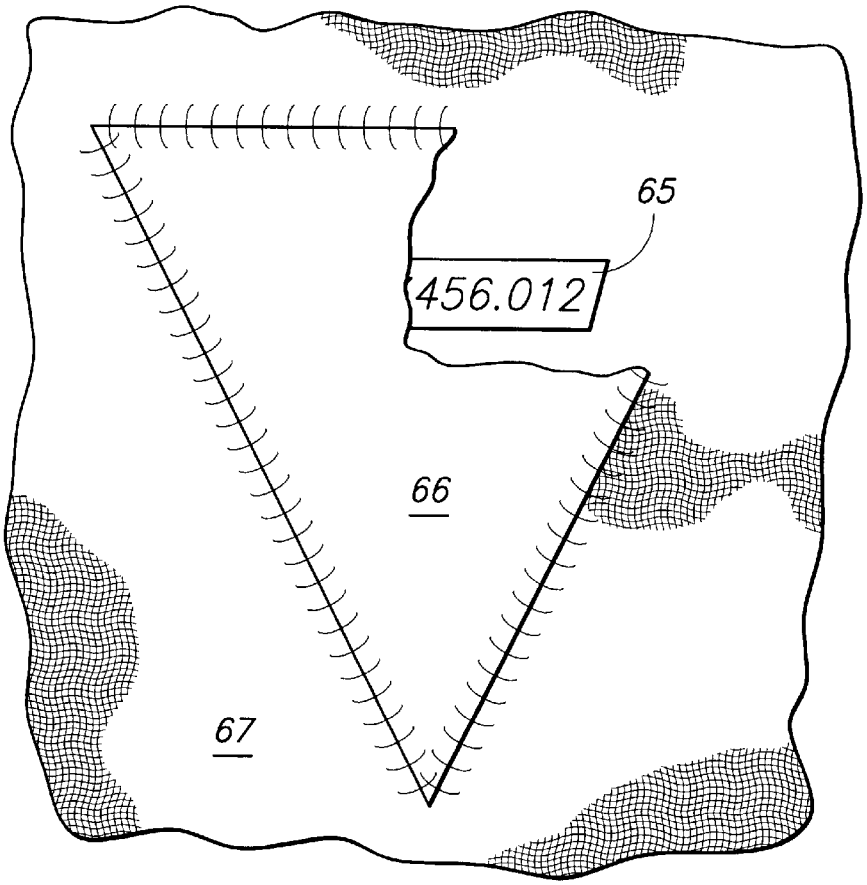
FIG. 11 shows a micro label strip segment sewn to a clothes label, which is sewn to cloth.

FIG. 11 shows continuous micro label strip segment 65 sewn to clothing label 66, which in turn is sewn to a section of cloth 67.

Figure 12:
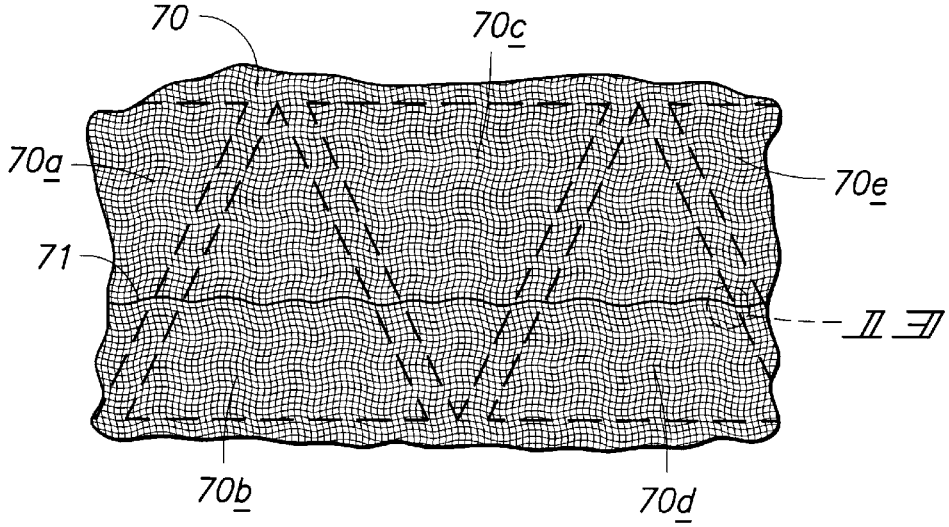
FIG. 12 shows cloth with a micro label woven therein, the cloth including a pattern therein for later cutting into other clothing articles.

FIG. 12 illustrates a section of cloth 70 from which several triangular clothing labels will be cut according to the pattern shown, namely, label 70*a*, label 70*b*, label 70*c*, label 70*d* and label 70*e*. Before the clothing labels are cut from the cloth according to the patterns shown, continuous micro label strip 71 is woven into the cloth 70.

Figure 13:
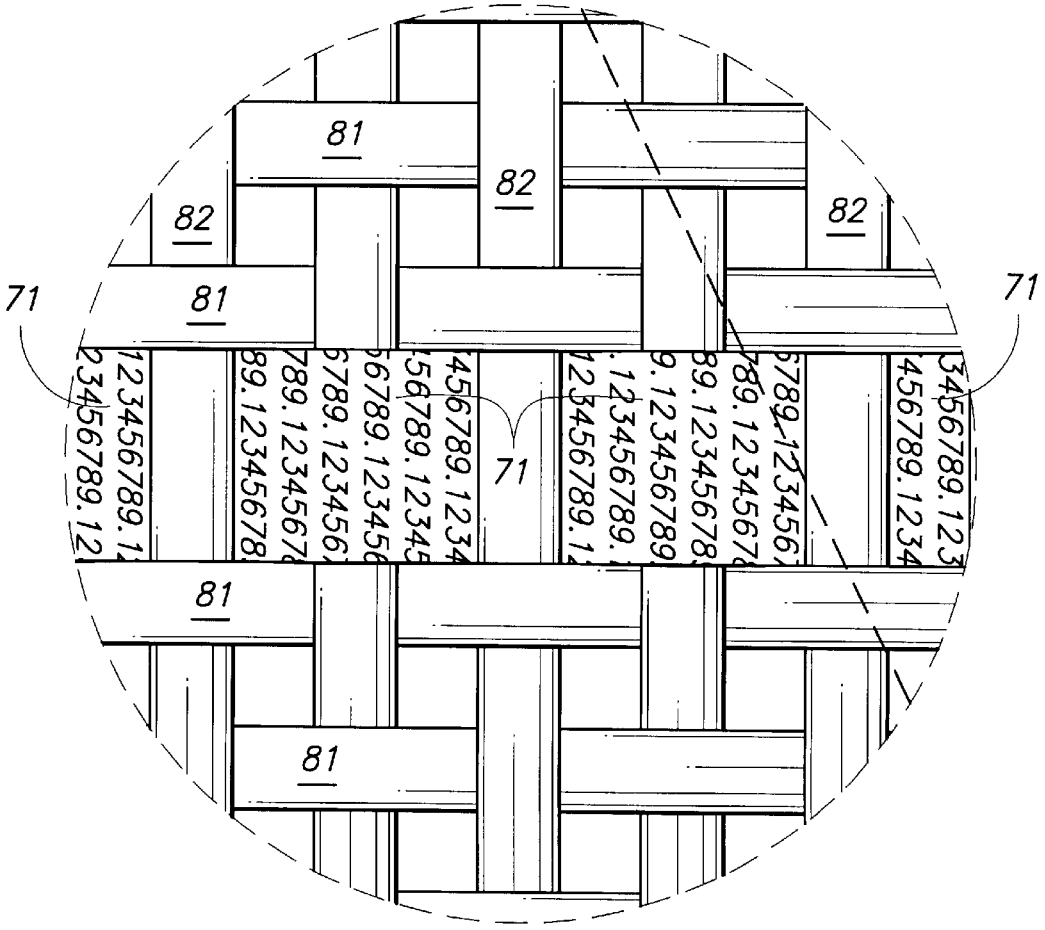
FIG. 13 shows an enlarged view from the cloth in FIG. 12, illustrating a continuous micro label strip woven into the cloth.

FIG. 13 shows an enlarged view of the continuous micro label strip 71 woven into the cloth from FIG. 12. continuous micro label strip 71 is woven parallel to threads 81 and perpendicular to cross threads 82.

The micro label strip can be woven into the cloth by utilization of known machinery and looms in the same manner in which cloth threads are woven on a loom or similar known equipment. The micro label strip can be attached to industry standard bullets and woven into the cloth, by known industry air weaving techniques or by known transverse arm looms.

The micro label strips which are woven can be one millimeter in width as an example, or less, and what length or continuous length desired for the application.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. Cloth containing a micro label identifier strip, and comprising:

a. a section of cloth; and b. a continuous micro label identifier strip interlaced into the cloth.

2. Cloth containing a micro label identifier strip as recited in claim 1, and in which the continuous micro label is comprised of:

a. a plurality of transverse rows, each row including characters, a predetermined plurality and combination of characters comprising an identifier; and b. each continuous micro label includes at least one identifier.

3. Cloth containing a micro label identifier strip as recited in claim 1, and in which the continuous micro label further comprises:

a. one or more longitudinal rows, each row including at least one identifier, each identifier comprising a predetermined plurality and combination of characters.

4. Cloth containing a micro label identifier strip, and comprising:

a. a section of cloth; and b. a continuous micro label identifier strip sewn onto the cloth.

5. Cloth containing a micro label identifier strip as recited in claim 4, and in which the continuous micro label is comprised of:

a. a plurality of transverse rows, each row including characters, a predetermined plurality and combination of characters comprising an identifier; and b. each continuous micro label includes at least one identifier.

6. Cloth containing a micro label identifier strip as recited in claim 4, and in which the continuous micro label further comprises:

a. one or more longitudinal rows, each row including at least one identifier, each identifier comprising a predetermined plurality and combination of characters.

* * * * *